US008998645B2

(12) United States Patent
Vanaleck et al.

(10) Patent No.: US 8,998,645 B2
(45) Date of Patent: Apr. 7, 2015

(54) HERMAPHRODITIC INTERCONNECT SYSTEM

(71) Applicant: Ohio Associated Enterprises, LLC, Painesville, OH (US)

(72) Inventors: John T Vanaleck, Painesville, OH (US); Alan L Roath, Madison, OH (US)

(73) Assignee: Ohio Associated Enterprises, LLC, Painesville, OH (US)

( * ) Notice: Subject to any disclaimer, the term of this patent is extended or adjusted under 35 U.S.C. 154(b) by 102 days.

(21) Appl. No.: 13/657,222

(22) Filed: Oct. 22, 2012

(65) Prior Publication Data

US 2013/0102199 A1 Apr. 25, 2013

Related U.S. Application Data

(60) Provisional application No. 61/549,921, filed on Oct. 21, 2011.

(51) Int. Cl.

| | |
|---|---|
| ***H01R 24/00*** | (2011.01) |
| ***H01R 24/84*** | (2011.01) |
| *H01R 13/405* | (2006.01) |
| *H01R 13/518* | (2006.01) |

(52) U.S. Cl.
CPC ..... *H01R 24/84* (2013.01); *H01R 13/405* (2013.01); *H01R 13/518* (2013.01)

(58) Field of Classification Search
CPC .. H01R 13/2442; H01R 13/514; H01R 11/32; H01R 12/57; G06K 7/0021
USPC ..... 439/626, 660, 884, 74
See application file for complete search history.

(56) References Cited

U.S. PATENT DOCUMENTS

| | | | | |
|---|---|---|---|---|
| 5,035,639 | A * | 7/1991 | Kilpatrick et al. | 439/290 |
| 5,057,028 | A * | 10/1991 | Lemke et al. | 439/101 |
| 5,098,311 | A * | 3/1992 | Roath et al. | 439/295 |
| 5,104,341 | A | 4/1992 | Gilissen et al. | |
| 5,167,528 | A * | 12/1992 | Nishiyama et al. | 439/489 |
| 5,181,855 | A * | 1/1993 | Mosquera et al. | 439/74 |
| 5,192,232 | A * | 3/1993 | Lenz et al. | 439/660 |
| 5,620,340 | A | 4/1997 | Andrews | |
| 5,639,248 | A * | 6/1997 | Yagi | 439/74 |
| 5,775,947 | A | 7/1998 | Suzuki et al. | |
| 5,902,136 | A * | 5/1999 | Lemke et al. | 439/74 |
| 6,146,202 | A | 11/2000 | Ramey et al. | |
| 6,193,537 | B1 * | 2/2001 | Harper et al. | 439/291 |
| 6,371,773 | B1 | 4/2002 | Crofoot et al. | |
| 6,454,610 | B1 * | 9/2002 | Yu | 439/660 |
| 6,540,529 | B1 * | 4/2003 | Yu | 439/74 |
| 6,846,202 | B1 * | 1/2005 | Schmidt et al. | 439/660 |
| 6,851,954 | B2 * | 2/2005 | Ashman et al. | 439/70 |
| 6,939,173 | B1 * | 9/2005 | Elco et al. | 439/607.34 |
| 7,452,249 | B2 * | 11/2008 | Daily et al. | 439/825 |

(Continued)

*Primary Examiner* — Abdullah Riyami
*Assistant Examiner* — Vladimir Imas
(74) *Attorney, Agent, or Firm* — Renner, Otto, Boisselle & Sklar, LLP

(57) ABSTRACT

An electrical interconnect system employs electrical connectors in which the contacts are identical for both the male and the female side of the connection. Contacts are arranged in a linear header and multiple header pairs are arranged in a dielectric matrix or grid. The grid is an external dielectric frame capable of providing load bearing and geometry requirements. This arrangement results in a cost-effective construction that features very high electrical bandwidth capabilities and an extremely rugged product.

13 Claims, 18 Drawing Sheets

(56) References Cited

U.S. PATENT DOCUMENTS

| | | | | |
|---|---|---|---|---|
| 7,785,152 | B2 * | 8/2010 | Yi et al. | 439/660 |
| 7,892,037 | B2 * | 2/2011 | Kodera et al. | 439/660 |
| 7,976,326 | B2 * | 7/2011 | Stoner | 439/295 |
| 8,137,119 | B2 * | 3/2012 | Stoner | 439/108 |
| 8,147,254 | B2 * | 4/2012 | Shuey et al. | 439/74 |
| 8,147,268 | B2 * | 4/2012 | Shuey et al. | 439/371 |
| 8,277,241 | B2 * | 10/2012 | Horchler et al. | 439/295 |
| 2013/0102177 | A1 | 4/2013 | Venaleck et al. | |

* cited by examiner

BOARD LAYOUT

HERMAPHRODITIC INTERCONNECT SYSTEM

This application claims priority to U.S. Provisional Application 61/549,921, filed Oct. 21, 2011, which is incorporated herein by reference in its entirety.

BACKGROUND

In the field of rugged, high-reliability connectors, such as military and aerospace connectors, the metal circular shell design is well known. Typically, these shells will house connectors that have a male and female orientation. Generally, on the female side, the contacts are protected by a dielectric shroud, while the male side will be a standing pin array vulnerable to damage by intrusion. Also, these pin and socket arrays do not generally have superior high-frequency data transmission capabilities. Additionally, these pin and socket arrays have pin density limitations unless the mechanical size is made very small, at which time, the contacts are quite fragile.

SUMMARY OF THE INVENTION

The present invention seeks to provide a connection scheme in which, at very high-pin density, the connector will have data transmission capabilities in excess of 20 gigabits per second per differential pair, and neither side has a mechanical vulnerability. While the preferred embodiment employs a metal circular shell to house the dielectric matrix and contacts, other shapes, such as rectangular or elliptical may be employed. Additionally, while the preferred embodiment is shown having a unique contact arrangement to accommodate high frequency differential pairs with a ground, signal, signal, ground format, the invention will accommodate single line geometries as well as other configurations.

One aspect of the invention is to provide rectangular beam contacts in a header array wherein the contacts are arranged in line with a constant space between them, where such space constitutes an edge coupling resulting in a required impedance.

Another aspect of the invention teaches special geometry of the dielectric where the contact emerges from the header along with a modified contact shape at that point such that the system impedance is held to close tolerance while not compromising the mechanical strength of the beam.

Still another aspect of the invention is the rounded shape of the contact tip outside of the current path. This shape reduces the metal in this critical area and decreases the effect of the "stub", while minimizing row-to-row coupling.

Still another aspect of the invention is to stack pairs of like headers, one pair back to back and one pair front to front to form a male and female mating pair.

Yet another aspect of the invention is a method of stacking multiple pairs of headers to avoid stacking tolerance that would interfere with mating-like arrays. Pairs of headers are aligned back to back with a flexible wall between this pair and its nearest pair companion. Ribs on the outside of the header pair deflect the flexible wall such that a clamping force is established between adjacent header pairs. The flexible wall will deflect more or less depending on the header size, yielding more or less clamping force, but maintaining the distance between pairs.

Still another aspect of the invention shows that when the mating contact rows are aligned such that the center lines of the contacts are co-linear, then male and female arrays of like headers will mate having the equal deflection of one stack thickness plus any fixed offset at the contact point.

An additional aspect of the invention identifies 5 zones in the signal path through the connector, plus two variations of Zone 1, one for cable egress and one for circuit board mounting.

Another aspect of the invention teaches that odd stacks of headers, as in 4-½ pairs or 6-½ pairs, etc. will result in a perfect hermaphroditic connector with both header arrays and grid retainers being identical. Even numbers of pairs require a grid retainer that has unique male and female components.

Further, the invention teaches that the external loads provided by the grid or dielectric frame are the same independent of how many pairs of headers are in the connector.

According to another aspect of the invention, a connector is disclosed that in the active interface the contacts are identical, arranged in a linear header spaced for electrical function, and the headers are arranged in pairs such that one pair mounted face-to-face, will mate with a pair of like headers mounted back-to-back, and many such pairs can be stacked to give the capacity required.

According to yet another aspect of the invention, an electrical connector includes: a first element; and a second element that mates with the first element; wherein each of the elements includes headers each with a header body and electrical contacts in the header body; and wherein for one of the elements the headers of that element are mounted face to face, and for the other of the elements the headers of that element are mounted back to back.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

An electrical interconnect system employs electrical connectors in which the contacts are identical for both the male and the female side of the connection. Contacts are arranged in a linear header and multiple header pairs are arranged in a dielectric matrix or grid. The grid is an external dielectric frame capable of providing load bearing and geometry requirements. This arrangement results in a cost-effective construction that features very high electrical bandwidth capabilities and an extremely rugged product.

Figure 1A:
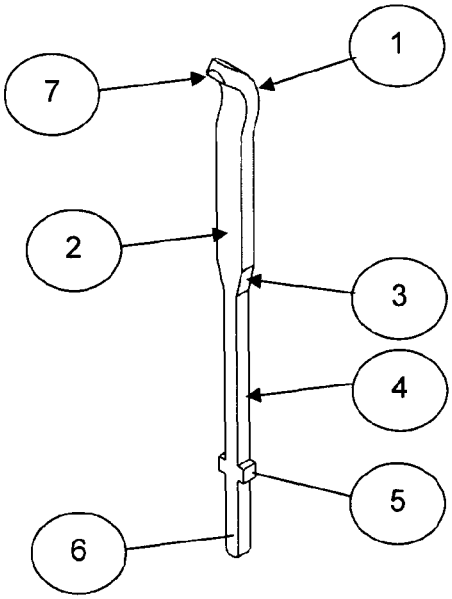
FIG. 1A is an isometric view of a typical single beam contact with attendant features identified.
Figure 1B:
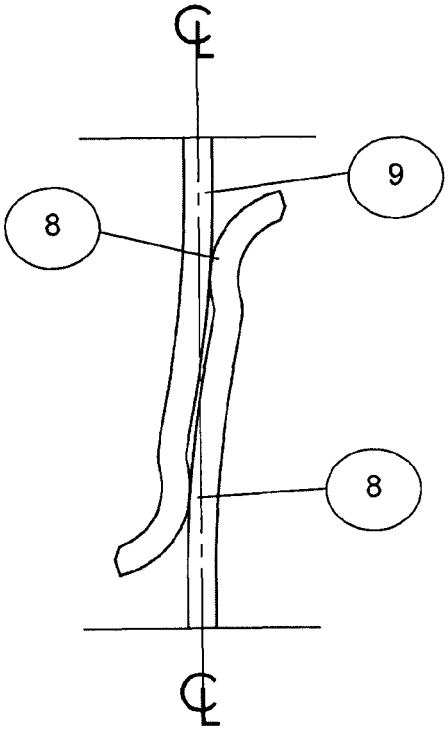
FIG. 1B is a side view showing a single pair of beam contacts in engagement.

FIGS. 1A and 1B are examples of a single beam contact. The apex of bend (1) constitutes the primary contact point. The operating beam is shown at (2). Item (3) is a detail that will be explained later. (4) is the continuation of the contact through a dielectric header. Item (5) is a circuit board standoff and impedance corrector. Item (6) is the tail that can be soldered into a circuit board or configured for welding to a cable end. Item (7) is the tip form that features a lead in angle and a tip clearance relief that allows more deflection before interfering with a constraining wall.

FIG. 1B shows a typical contact pair mated using a common centerline (9). Note that the deflection of each contact is identical when the center lines are common and that the total deflection is approximately one stock thickness plus any offset at bend (1).

Figure 2:
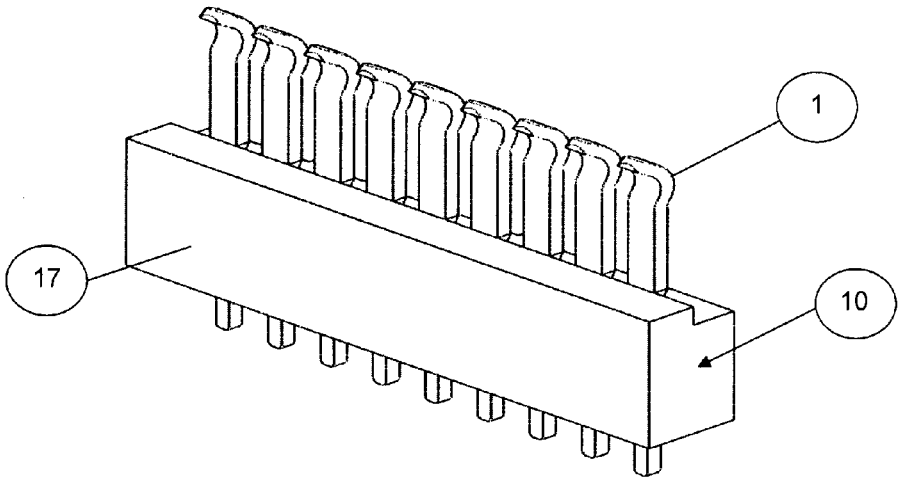
FIG. 2 is a rear isometric view of a header with a linear array of beam contacts.
Figure 3:
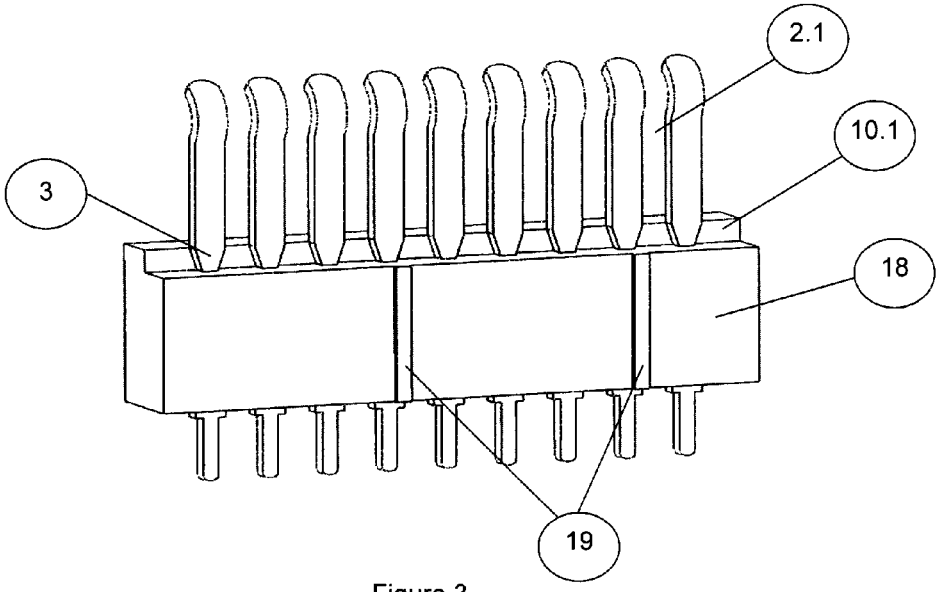
FIG. 3 is a front isometric view of a header with a linear array of beam contacts.

FIGS. 2 and 3 show the arrangement of FIGS. 1A and 1B contacts in a linear header wherein the header body (10) is molded around the contacts and is of an appropriate dielectric material. These headers are a basic building block of the connector invention. FIG. 2 shows the front side of the header with no feature other than a flat side. FIG. 3, however, details several important features. First, space (2.1) is important in determining the fundamental impedance of the contact scheme. This configuration will seek to maintain this impedance at a constant value throughout the signal path. At (10.1), the header dielectric forms a ridge which both supports the contact on the compression side of the bending when the contacts are engaged, and provides additional dielectric needed to maintain the impedance of the system. The contact at (3) is seen to taper to a smaller dimension before it enters the header dielectric. This is necessary as the space between contacts edges will increase in the dielectric in order to maintain impedance. The gradual transition formed by the taper and backed by the dielectric ridge yields a near constant impedance transition, at the same time supports the beam bending moments.

Also seen on the front side (18) of the header in FIG. 3 are two protrusions (19). These protrusions interact with a frame (16), providing transverse loads on the header to counteract the contact torsional loads and maintain the relative true position of the headers on center.

Figure 4:
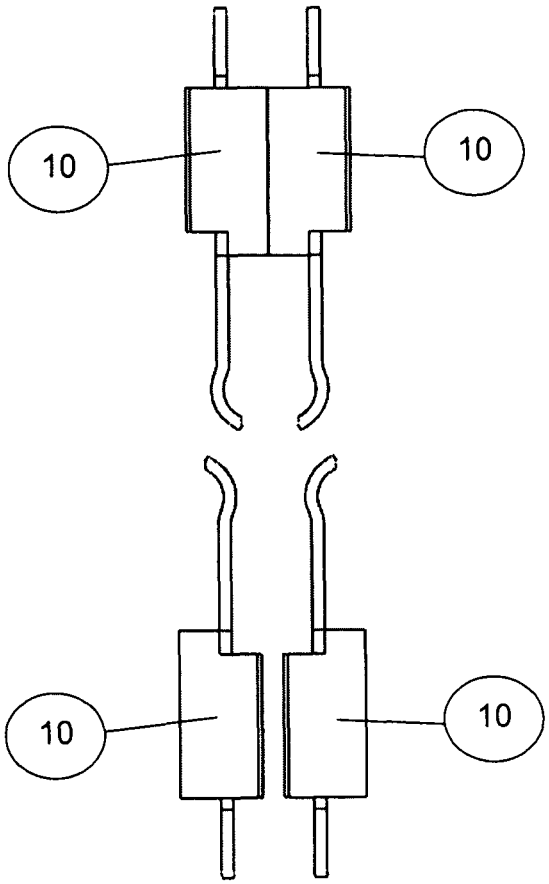
FIG. 4 is a side view of a partially assembled connector pair showing a male pair arrangement of headers and a female pair arrangement of headers.

FIG. 4 shows the basic arrangement of the building block headers in a front-to-front pair forming a male element, and a back-to-back pair, forming a female element. Note, that these are all the same part arranged in two different ways.

Figure 5:
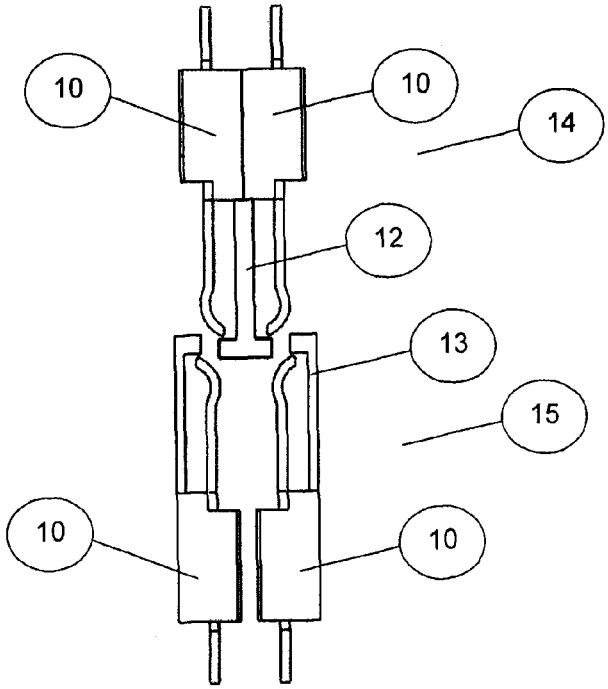
FIG. 5 is a side view of partially assembled connector with the addition of grid protectors.

FIG. 5 shows the same male, female pair arrangement (14) (15), but with the addition of a grid protector (12) and (13).

Figure 6:
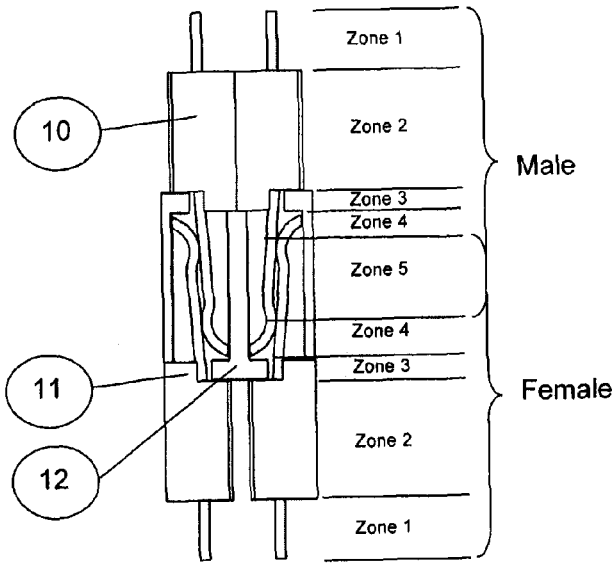
FIG. 6 is a side view of a fully assembled connector pair showing various zones along the signal path.

FIG. 6 has the male and female pair mated as they would be in use, and outlines five (5) important zones of the signal path through the connector. Zone 1 on either end of the path can be configured for either a circuit board termination or a cable termination. Special geometries will be required in either case and is detailed later. Zone 2 through the header dielectric requires a reduced contact cross section to accommodate the change in electric field due to the dielectric constant enabling a constant impedance. Zone 3 is where the reduced cross section contact emerges from the header dielectric and enters an air environment. Dielectric materiel on either side (11) and (12) is adjusted to give a near-perfect system impedance match.

Zone 4 has the "stub" contact end that is conductor not in the signal path and constitutes a parasitic capacitor. This feature is deleterious and is minimized compared to other contact schemes by making the bend (1) a small as possible while still performing the dual function of offset contact point and a lead in to provide controlled engagement with its mating contact. Zone 5 is a dual-signal path wherein the signal splits and travels both legs of the mating contacts simultaneously. This zone is predominantly in an air dielectric and has two contact edges facing each other. Since, in this zone, the dielectric constant for air is a fixed value, the width of the contacts determined by the required beam strength and the spacing along with the impedance requirement sets the essential repeat distance for the entire connection scheme.

Figure 7:
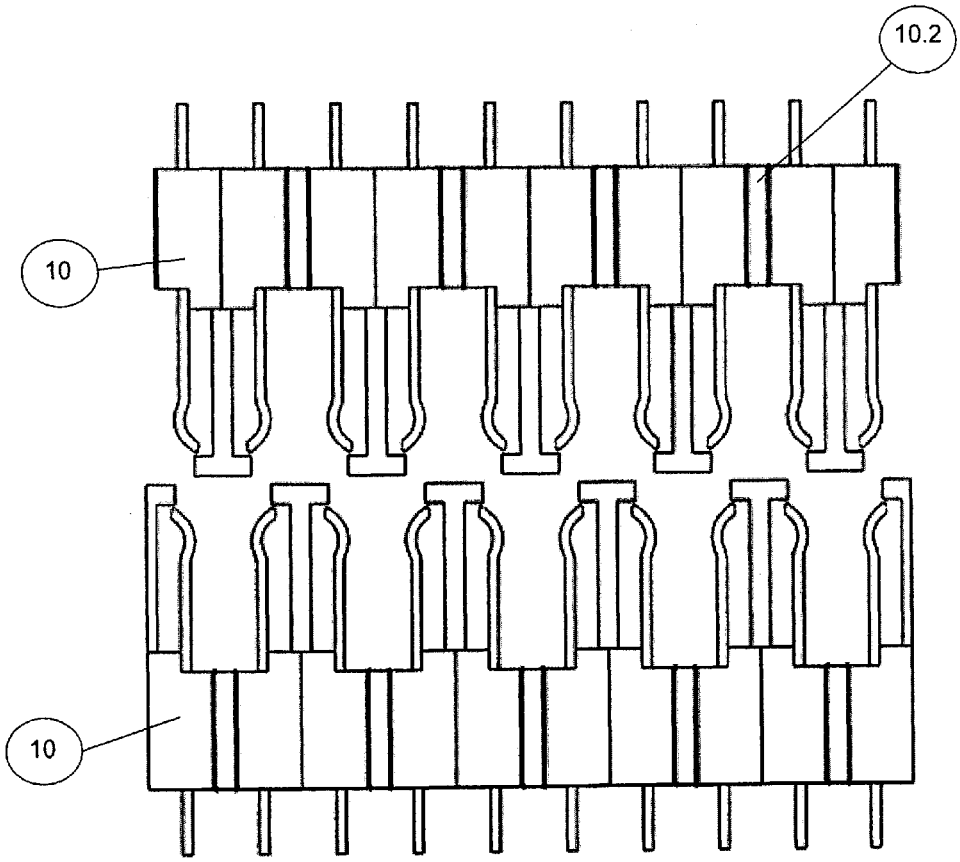
FIG. 7 is a side view of a multiple pair array with an even number of headers.
Figure 8:
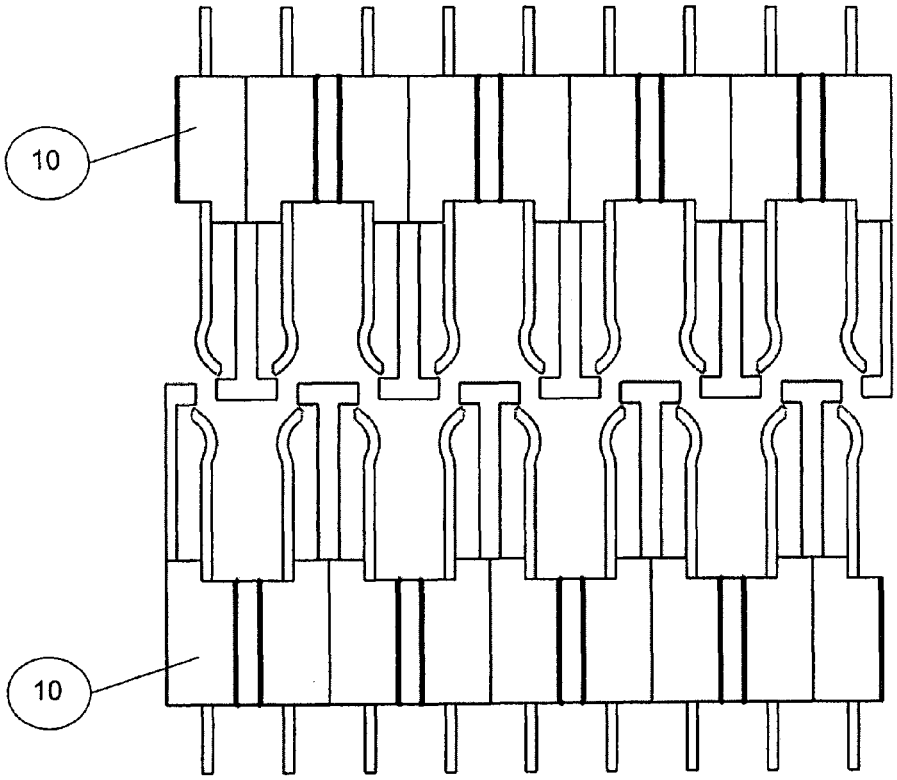
FIG. 8 is a side view of a multiple pair array with an odd number of headers having a hermaphroditic capability.
Figure 9:
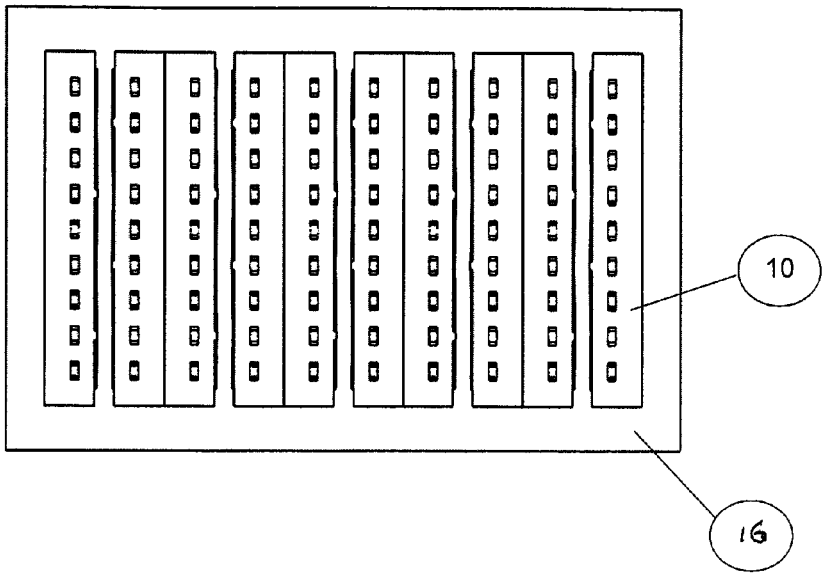
FIG. 9 is a plan view of a header array housed in a rectangular grid with flexible interstitial ribs and locating features
Figure 9:
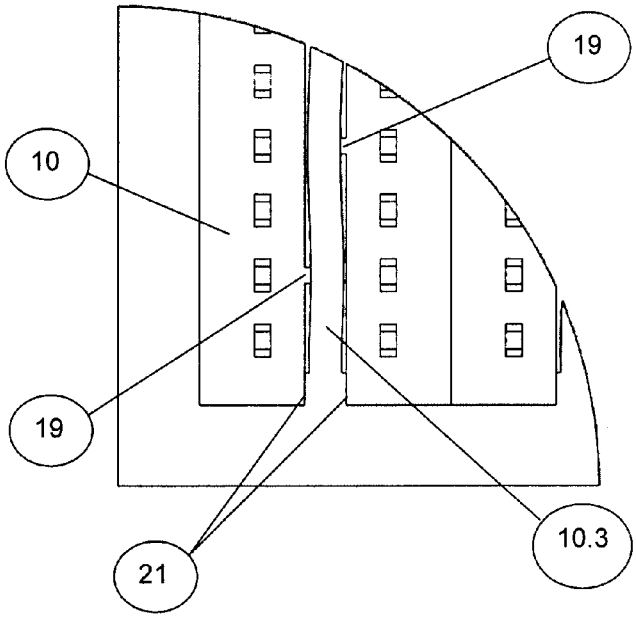

FIG. 7 shows a stacked array of five (5) male pairs of headers and five (5) female pairs of headers. These arrays are arranged such that the center lines of the contacts (9) are aligned. The spaces between the pairs (10.2) are the preload ribs that provide restoring forces F. FIG. 8 shows a similar arrangement of stacked headers but with only 4-½ pairs of both male and female kinds. Once again, the stacks are arranged such that the contact center lines are aligned allowing for proper engagement. This stacked array is identical on top and bottom yielding a true hermaphroditic set. This illustration demonstrates that odd numbers of headers will form a true hermaphroditic connector pair. FIG. 9 shows the arrangement of the female header pairs in a grid or carrier. The section of this grid is shown, as in FIG. 7. FIG. 9 shows ribs (10.3) of the frame (16) that are between the headers. Item (21) is a portion of the ribs (10.3), which fits closely to the headers (10) and is the datum that positions the headers. Because of finite tolerancing in the manufacture of the plastic parts, the fit at (21) cannot be exact and must remain somewhat loose. The headers, however, must be held tightly together since any looseness would allow the contacts to lose their programmed fit; and, consequently, not have proper loading, and their performance as an electrical contact would be compromised. The ribs (10.3) are thinner than the space between the headers. The small protrusions (19) on the headers (10) or the ribs (10.3) will force the ribs (10.3) to deflect into the space between the thinner rib (10.3) and the headers (10). Since the small protrusions (19) are placed asymmetrically on the header (10), as shown in FIG. 3, and since the headers (10) are placed back to back, the rib (10.3) will be forced to deflect into a serpentine shape, as shown. This deflection will impart a normal load on the headers and keep them tight even when the contacts are loaded.

Figure 10:
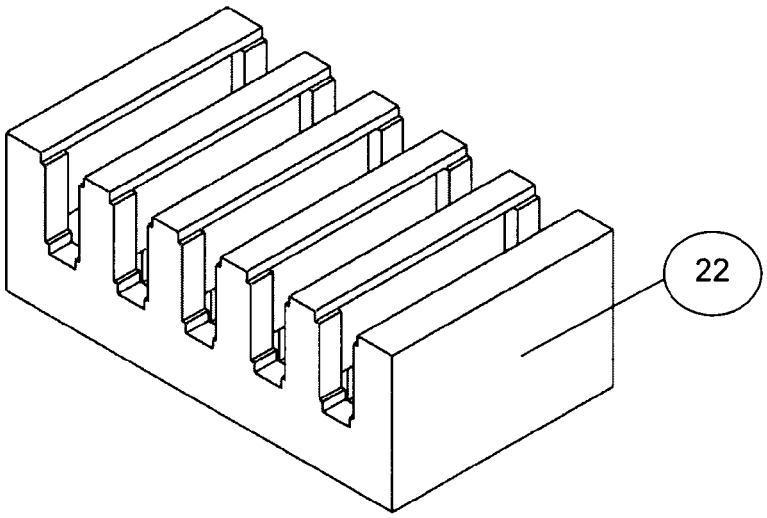
FIG. 10 is an isometric view of the female grid of an even array of headers.
Figure 11:
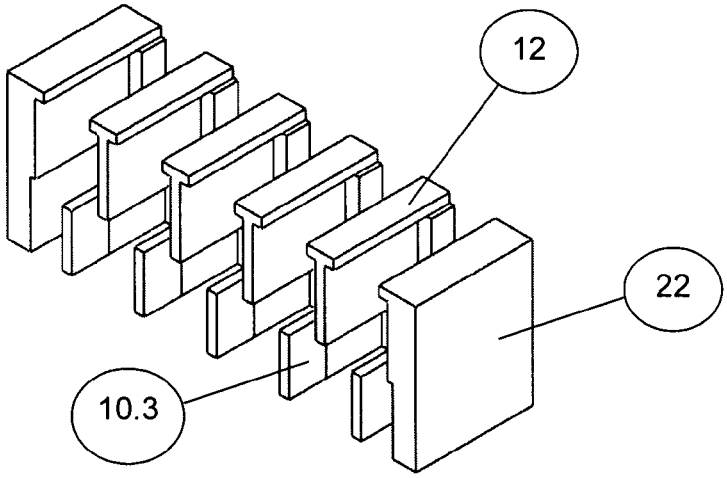
FIG. 11 is a sectioned isometric view of a female grid

FIG. 10 shows the female grid in an isometric view. FIG. 11 shows that same grid in a sectioned isometric view. Note the ribs (10.3) and the t-bar ribs (12).

Figure 12:
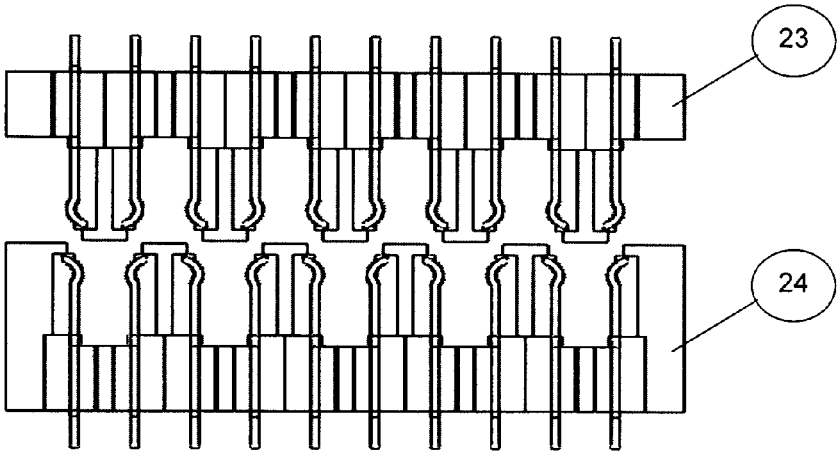
FIG. 12 is a sectioned side view of a male and female array complete with protective grids.
Figure 13:
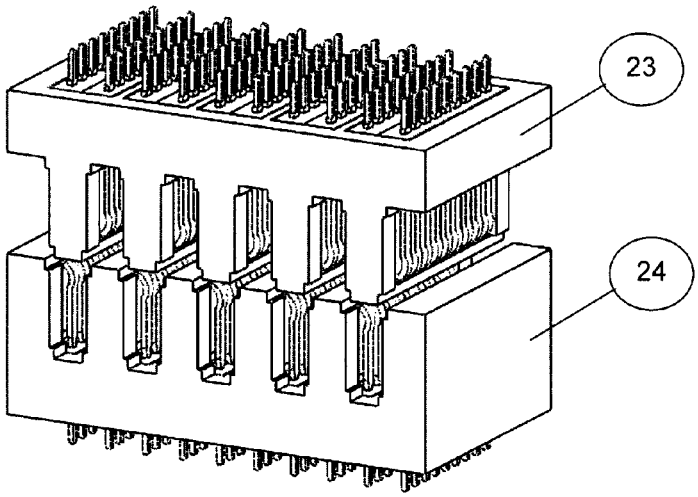
FIG. 13 is a separated isometric view of a male and female pair of complete rectangular connectors.
Figure 14:
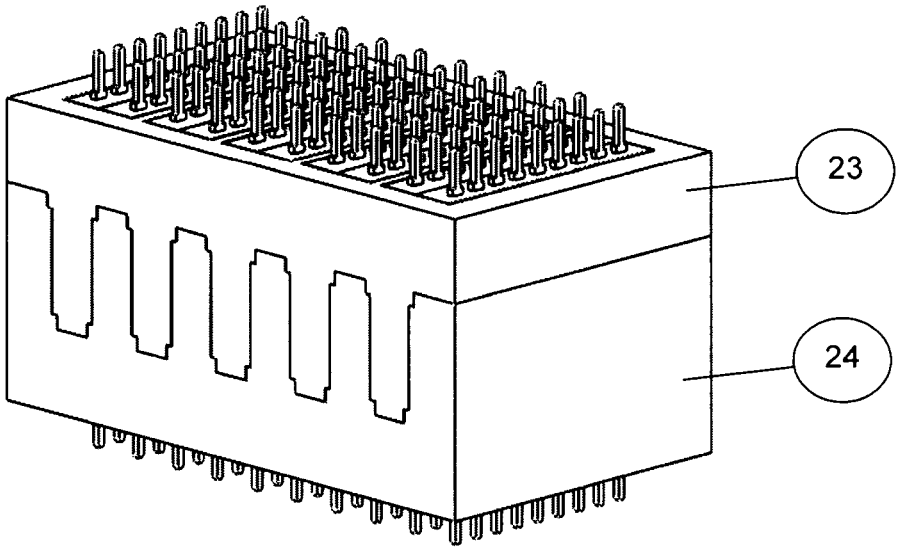
FIG. 14 is an assembled isometric view of a male and female grid array.
Figure 15:
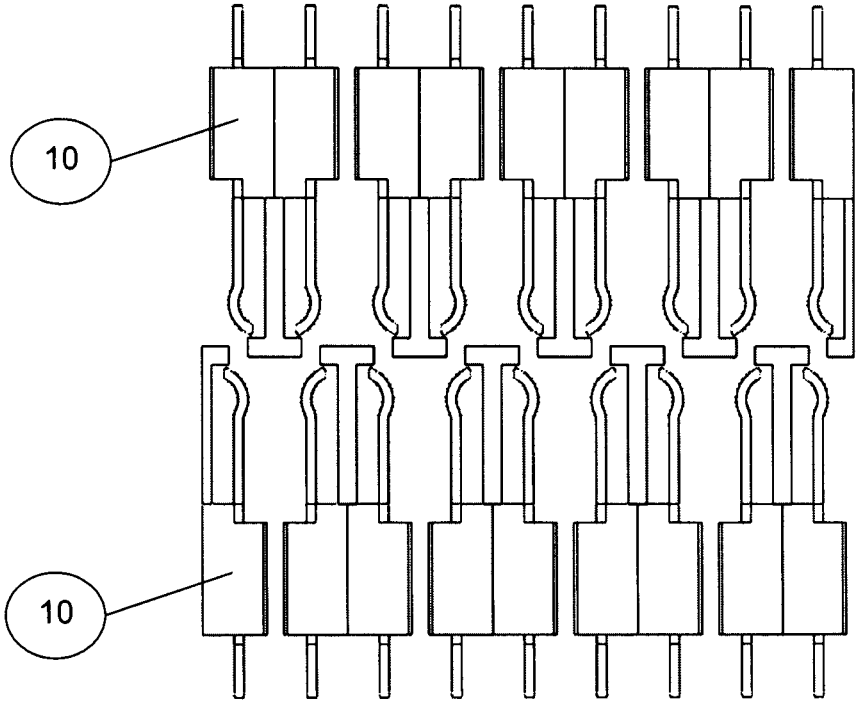
FIG. 15 is a repeat of FIG. 8 showing an odd number of headers in a linear array; male and female components are identical constituting a hermaphroditic pair.
Figure 16:
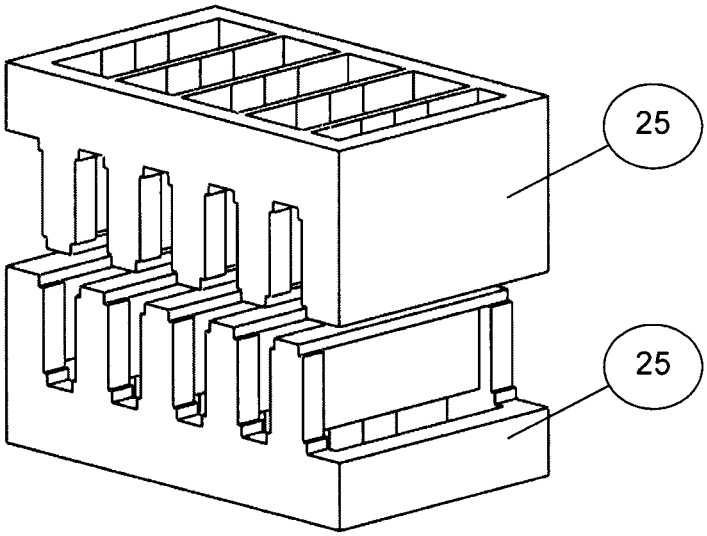
FIG. 16 is a separated isometric view of a hermaphroditic grid.
Figure 17:
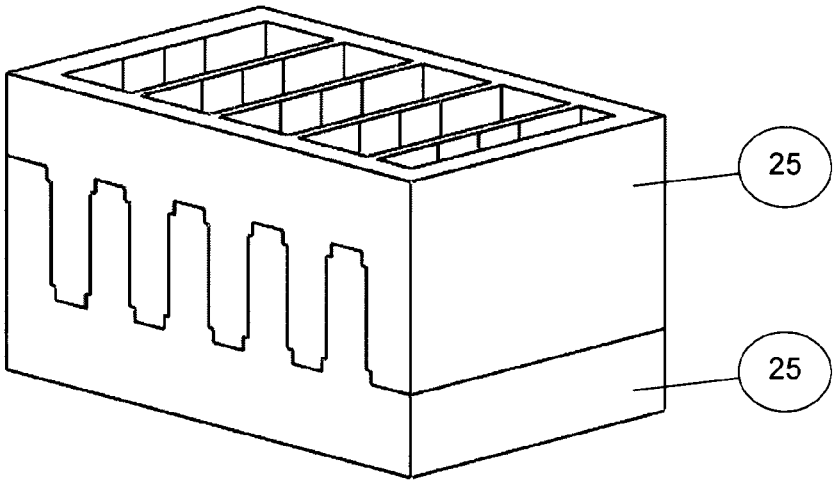
FIG. 17 is an assembled isometric view of a hermaphroditic connector pair.

FIG. 12 is a lateral section view of both the male header array (top) and the female header array (bottom) shown with their respective grid carriers (23) and (24). FIG. 13 is an isometric view of this connector pair before engagement. FIG. 14 shows the connector pair fully engaged. Note how the two profiles fit perfectly to form a completely covered box. FIG. 15 is similar to FIG. 12 except that there are nine (9) headers top and bottom instead of ten (10). This arrangement illustrates that an odd number of headers, as shown, will result in an identical array on top and on the bottom. This is the essential requirement to make the contact pair completely hermaphroditic. FIG. 16 shows the grid carrier that would accommodate nine headers. Note that the same part (25) is on top and on the bottom. FIG. 17 shows how these exact same parts will fit together to form a hermaphroditic pair.

Figure 18:
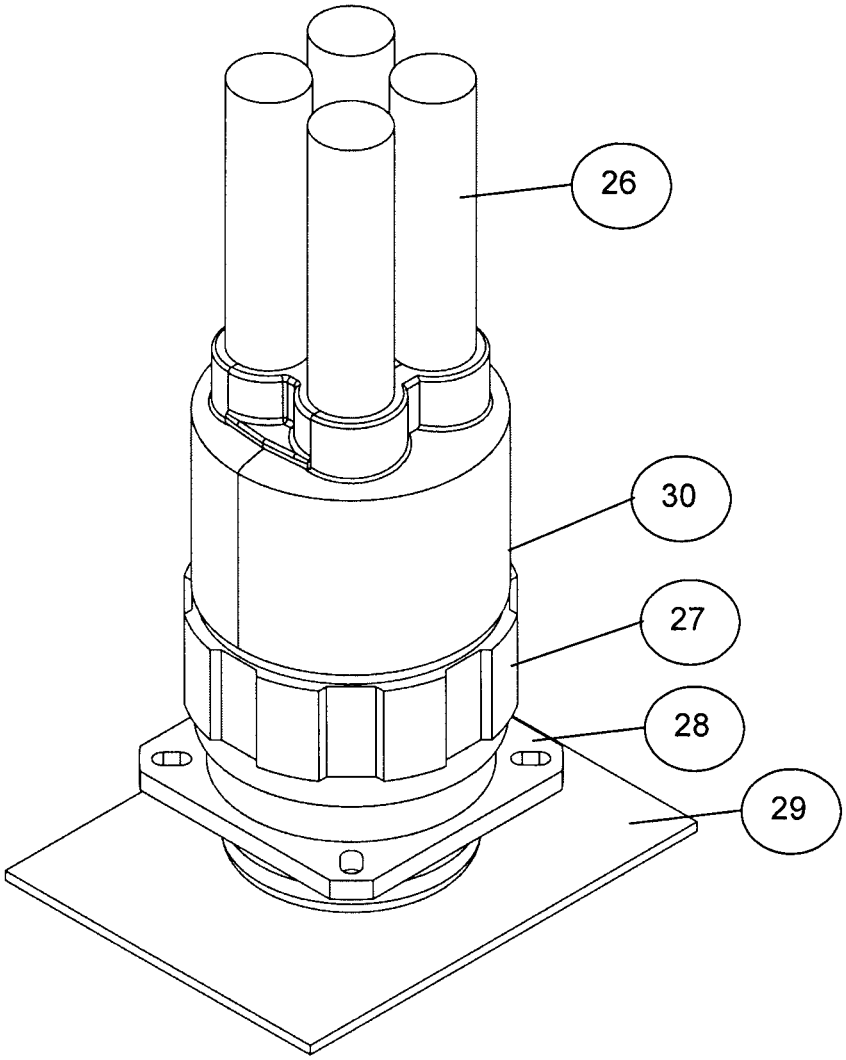
FIG. 18 is an isometric view of a circular board-to-cable connector assembled to a circuit board.
Figure 19:
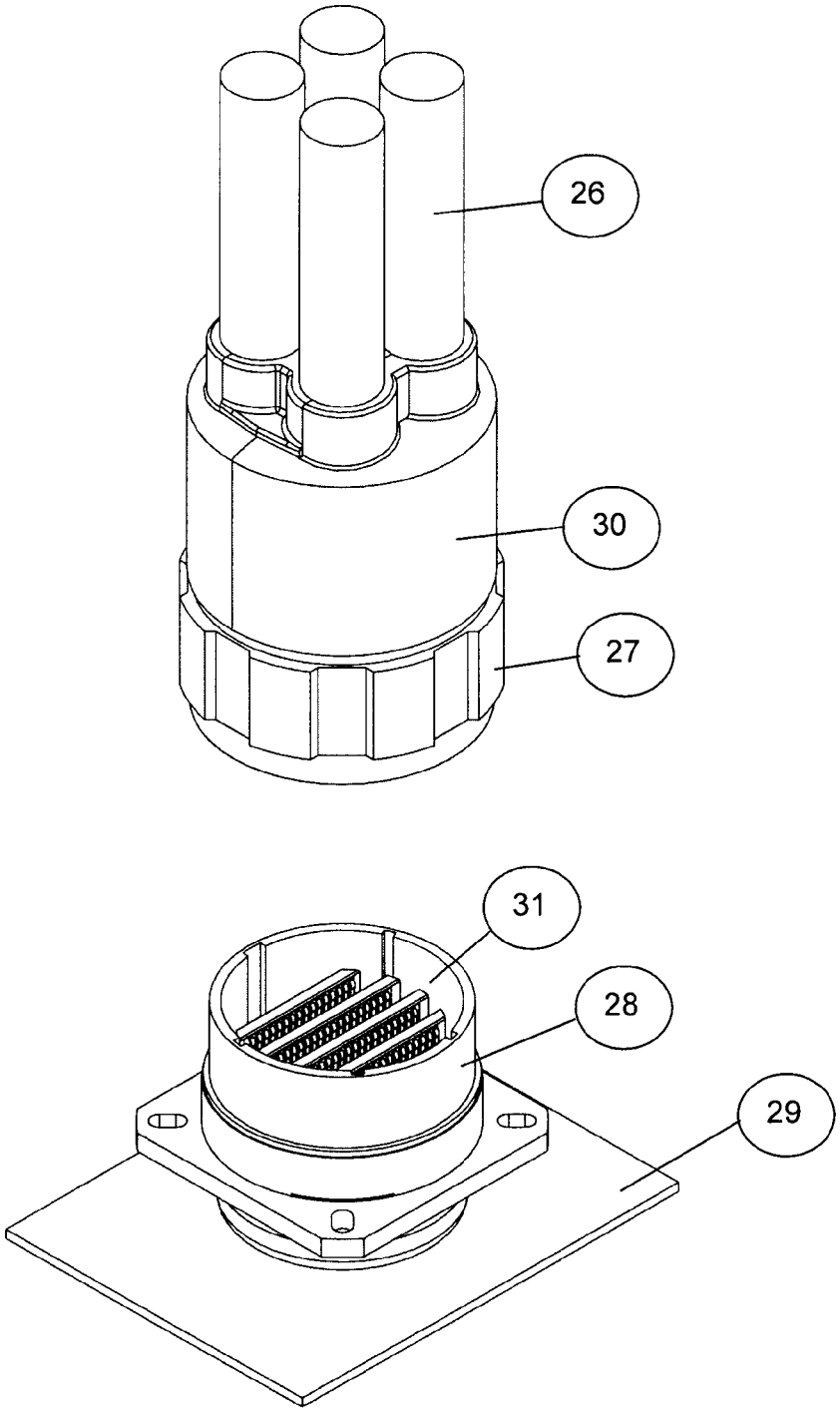
FIG. 19 is an isometric view of a circular board-to-cable connector with the two halves disengaged.
Figure 20:
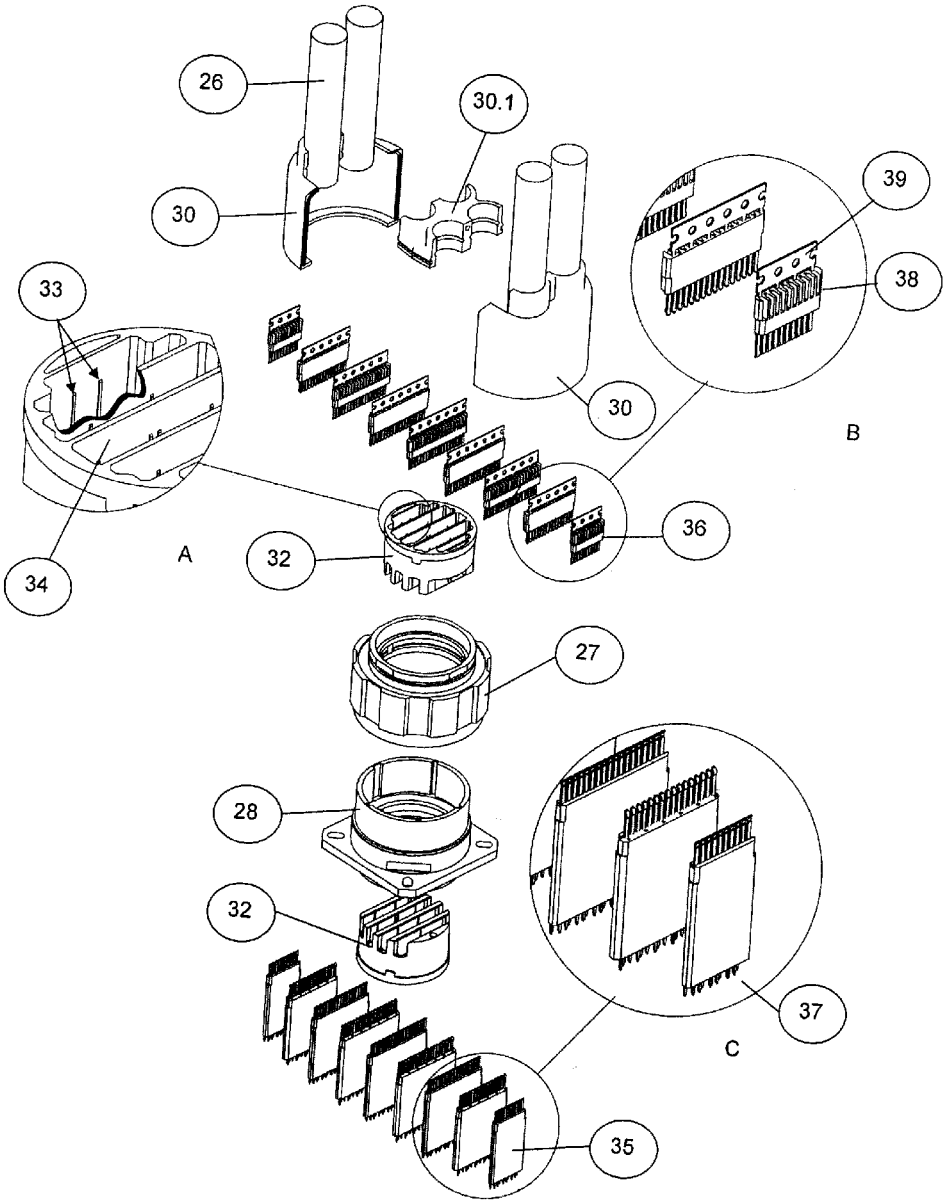
FIG. 20 is an exploded isometric view of a circular board-to-cable connector without the circuit board.

The aforementioned technology has been used in a rugged circular connector scheme that attach high-speed cables to a computer circuit board. FIG. 18 is an isometric exterior view showing the essential elements of this configuration. The circuit board shown as (29) and the board mount half of the connection scheme is shown as (28). The cables (26) emanate from the cable connector (30). These four (4) cables contain a multiplicity of data transmission lines. Other circuit—carrying conductors could be similarly utilized. The two (2) connectors are engaged and pulled tightly together by a threaded ring (27) forming a sealed pair. The board connector mounted to the computer circuit board, and the cable connector are shown separated in FIG. 19. Interior of the board connector (28) is showing the connector (31) that is the topic of this invention. The elements of this connector, in both the board connector and the cable connector are shown in the exploded view of FIG. 20. Three major elements are detailed in FIG. 20. They are the circular grid at A, the cable side header at B, and the board side header at C. The circular grid (32) is hermaphroditic, being identical in both the board connector and in the cable connector. This grid has unique features aside from the principles taught in FIG. 9. Instead of the preload protrusions (19) of FIG. 9 that are part of the headers (10), this embodiment has preload ribs (33) integral with the flexible ribs (34) of the grid. The headers (35) and (36) do not have preload ribs, as shown in FIG. 3 (Detail 19). The result is, however, the same. whether the loading elements are on the flexible ribs or on the headers. Also, since the envelope of the connector is circular, the headers are of various lengths depending on the chord length at the specific location in the circular shell. Note that there are nine (9) headers in both the board side connector and in the cable side connector. These nine headers, shown in details (35) and (30), are an odd number and populate the identical grids (32) to form a hermaphroditic connector pair. The hermaphroditic feature is evident only at the interface area, while the exit area of the board connector differs from the exit area of the cable connector. These areas are depicted in details (37), (38), (39) of FIG. 20. Detail (37) of FIG. 20 shows a rather long header body with contact tails suitable for interfacing with a circuit board. These tails can either be for soldering to circuit board vias, or they may be spring tails for press-fit application. On the cable side, the header array from the active contacts shows a series of ribs configured to isolate copper wires that are welded to each contact tail. Also shown is Detail (39), a common bus that connects all ground contacts together. Finally, in FIG. 20, the cables (26) egress the connector through a shell (30) that serves doubly as a strain relief and an electro-magnetic shield. Since the transmitted data is expected to be in a bandwidth of the radio frequencies, the shield is required to contain any unwanted radiation. The shell (30) manufactured of a metallic materiel, or other conductor, is in three pieces. Two identical pieces (30) and a third piece (20.1) that fits centrally between the two outer shells and forms the completed seal between the three elements. Special provision is made to allow good conduction between the cable shielding and the connector shell (30) and (30.1).

Figure 21A:
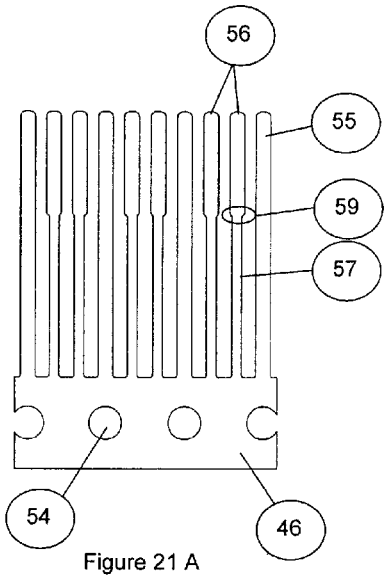
FIG. 21A is a plan view of the contact comb for the cable and headers.
Figure 21B:
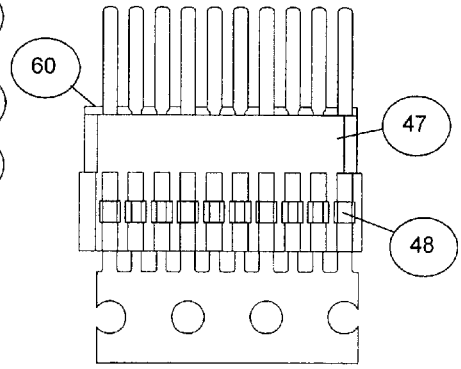
FIG. 21B is a plan view of the header with molded-in contact comb.
Figure 21C:
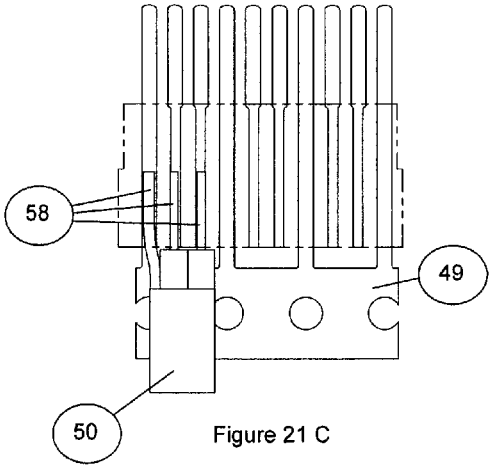
FIG. 21C is a plan view of the cable end header with a 3-wire cable attached, the signal contacts separated from the ground bus, and a phantom view of the header molded plastic.
Figure 21D:
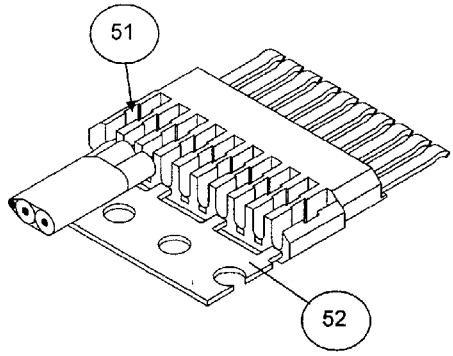
FIG. 21D is an isometric view of a cable header with contacts and wires attached.
Figure 21:
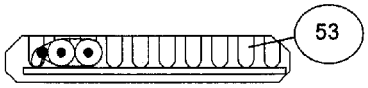
FIG. 21 is an end view of a cable header with contacts and wires attached.
Figure 22A:
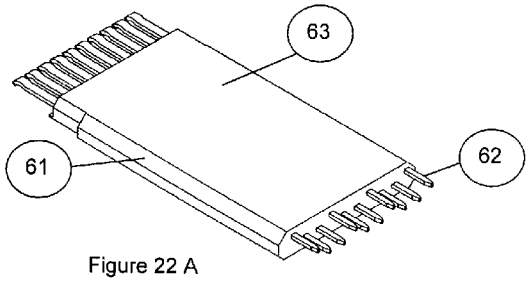
FIG. 22A is an isometric view of the board header.
Figure 22B:
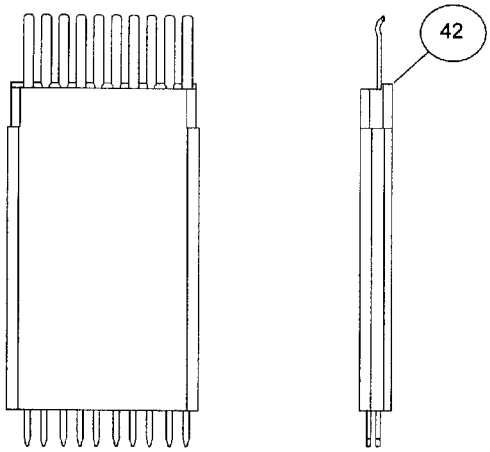
FIG. 22B is an orthogonal projection of a board header
Figure 22C:
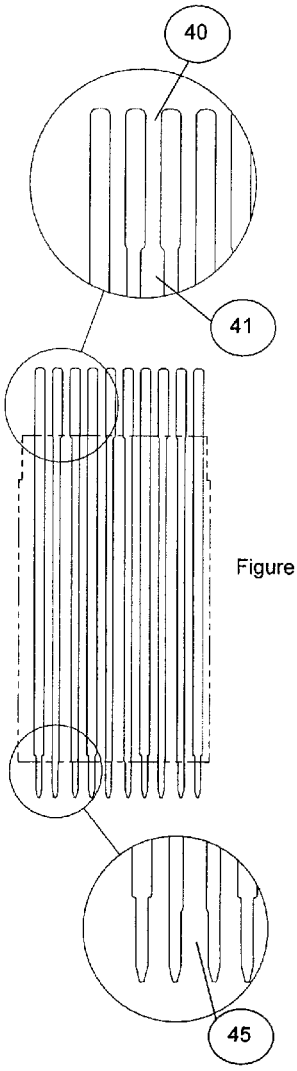
FIG. 22C is a plan view of the contact comb showing the header in phantom and the various contact shapes within the header.
Figure 22D:
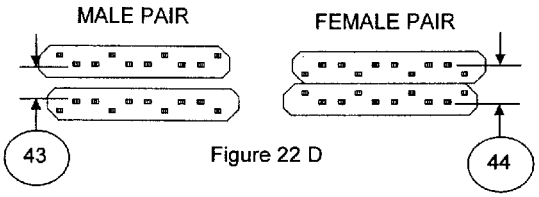
FIG. 22D shows a bottom view of a male pair of board headers and a female pair of board headers, and a board layout showing ground and signal arrangement.
Figure 22:
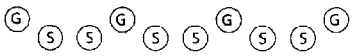
FIG. 22 is an illustration of an arrangement of ground and signal contacts.

The headers at B and C of FIG. 20 are detailed in FIG. 21 and FIG. 22. In FIG. 21, the cable header is featured. A typical stamped contact comb is shown at FIG. 21A (46). The stamping is organized to yield a connector pinout of ground, signal, signal ground configuration. The ground contacts (55) are characterized by their constant width throughout, while the signal contacts (56) show a reduced section (57) in the center. This reduced section is required to match the impedance through the dielectric of the header material at (47). Also shown at (59) is the tapered section of the signal contact that allow a gradual transition to the header overmold. This is a key section of the contact, as the ridge of plastic at (60) both supports the beam on the compression side of the bending moment, but also manages the impedance with the addition of plastic from the mating connector. Also shown at FIG. 21A is the common carrier (46) that has stamping pilot holes (54). This contact comb is placed in a plastic injection mold, and the header materiel is injected (47) to form the shapes shown at FIG. 21B. Note at (48) a square access hole is molded that gives access to the contact materiel on the underside. The header is further processed at FIG. 21C. First, the materiel of the signal contacts is removed adjacent to the common carrier (49). This is now possible since the signal contacts are held in place by the molded plastic of the header (47). The molded materiel is shown in phantom at FIG. 21C. Then transmission conductors are welded to the contacts at (50) by placing in slots (53) with welding electrodes above the wire and below the contact in the square access holes. The partially finished header with one differential pair transmission (50), attached at (51), is shown at FIG. 21D. Two more differential pair transmission lines will be attached similarly to complete the header assembly at FIG. 21D (52). The common carrier is shown isolated from the signal contacts and is the common conductor for all of the ground contacts.

Finally, the board side connector header is detailed in FIGS. 22-22D. The completed header is shown at FIG. 22A. Apparent in this illustration are the staggered tails at egress meant to interface with the computer circuit board. The stagger detailed in FIG. 22D is necessary to allow proper spacing of the ground vias to the signal vias to maintain impedance. Note that at FIG. 22D, the signal contacts emanate from the exact center of the header thickness. This feature allows signal symmetry when the headers are stacked either face-to-face or back-to-back. This feature is illustrated at FIG. 22D (43) and (44) that shows the signals in line left to right, while the grounds are exterior at (43) and are interior at (44). Not only does this feature yield symmetry for the signal contacts, but it also maximizes the row-to-row signal spacing giving the minimum crosstalk configuration. At A (61), we see a tapered end of the header also shown in FIG. 22D. This feature performs the header positioning requirement outlined previously in FIG. 9 Detail (21). This configuration shows there are various ways of achieving the necessary datum function.

At B (42), again the plastic support ridge is shown where the contact emerges from the header plastic. The various shapes of the contacts as they transit the header is shown in FIG. 22C. Of note is the typical signal contact spacing at (40) and (41) associated with air dielectric or plastic dielectric, as previously described. The contact widths vary accordingly to accommodate these required spacings. Of note, is the spacing (45) at the tail that enters the computer board. Materiel is removed from the inside faces of the contacts to give proper spacing in the dielectric represented by the computer circuit board. The common carrier has been removed all together since the ground contacts will be commoned at the ground plane in the circuit board.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector comprising:

a first element; and a second element that mates with the first element;

wherein each of the elements includes headers each with a header body and electrical contacts in the header body; and wherein for one of the elements the headers of that element are mounted face to face, and for the other of the elements the headers of that element are mounted back to back;

wherein the headers are substantially identical to one another in cross-sectional configuration, with the header bodies of all of the headers having a substantially identical cross-section body shape, and with the electrical contacts of all of the headers having a substantially identical placement within the respective header bodies;

wherein the electrical contacts are hermaphroditic contacts, and are all substantially identical;

wherein the header bodies are plastic and molded around the contacts;

wherein the contacts each include:

an operating beam; and a bend at a free end of the operating beam;

wherein the beam has a reduced cross-section in the header body, smaller than a cross-section outside the header body; and wherein the beam has a tapered portion between the cross-section outside the header body to the reduced cross-section;

wherein, when the elements are mated, the bends of the contacts of the first element contact the beams of the contacts of the second element, and the bends of the contacts of the second element contact the beams of the contacts of the first element;

wherein the header bodies have ridges that are in contact with the tapered portions, and that mechanically support the contacts when the beams of the contacts are bent by contact with bends of other of the contacts; and wherein the ridges electrically interact with the tapered portions of the contacts.

2. The electrical connector of claim 1, wherein each of the elements also includes additional headers.

3. The electrical connector of claim 2, wherein all of the headers have the same number of the contacts.

4. The electrical connector of claim 2, wherein some of the headers have more the contacts than other of the headers.

5. An electrical connector comprising:

a first element; and a second element that mates with the first element;

wherein each of the elements includes at least three headers each with a header body and electrical contacts in the header body;

wherein, for each of the elements, adjacent of the headers alternate between a face-to-face configuration and a back-to-back configuration, through a stack of headers, with for the first element, a first header is in the face-to-face configuration with a second header that is adjacent to the first header, and a third header that is adjacent to the second header in the back-to-back configuration with the second header; and for the second element, a first header is in the back-to-back configuration with a second header that is adjacent to the first header, and a third header that is adjacent to the second header in the face-to-face configuration with the second header;

wherein the electrical contacts are hermaphroditic contacts, and are all substantially identical;

wherein the header bodies are plastic and molded around the contacts;

wherein the contacts each include:

an operating beam; and a bend at a free end of the operating beam;

wherein the beam has a reduced cross-section in the header body, smaller than a cross-section outside the header body; and wherein the beam has a tapered portion between the cross-section outside the header body to the reduced cross-section; and wherein the header bodies each include grid protectors that overlie and protect the free ends of the operating beam during the mating of the elements.

6. The electrical connector of claim 5, wherein, when the elements are mated, the bends of the contacts of the first element contact the beams of the contacts of the second element, and the bends of the contacts of the second element contact the beams of the contacts of the first element.

7. The electrical connector of claim 5, wherein all of the headers have the same number of the contacts.

8. The electrical connector of claim 5, wherein some of the headers have more the contacts than other of the headers.

9. The electrical connector of claim 6, wherein the header bodies have ridges that support the contacts when the beams of the contacts are bent by contact with bends of other of the contacts.

10. An electrical connector comprising:

a first element; and a second element that mates with the first element;

wherein each of the elements includes headers each with a header body and electrical contacts in the header body; and wherein for one of the elements the headers of that element are mounted face to face, and for the other of the elements the headers of that element are mounted back to back;

wherein the header bodies have protrusions;

wherein the each of the elements includes a frame that receives the headers of that element; and wherein, for each of the elements, the protrusions engage ribs of the frame, to maintain position of the headers within the frame.

11. The electrical connector of claim 10, wherein the ribs each deflect into a serpentine shape when engaged by the protrusions.

12. The electrical connector of claim 10, wherein the ribs are in spaces between adjacent header bodies.

13. The electrical connector of claim 12, wherein interaction of the protrusions with the ribs provide transverse loads on the headers to counteract the contact torsional loads on the headers, to maintain proper positioning of the headers within the frame.

* * * * *